United States Patent [19]

Fisher et al.

[11] 4,401,853

[45] Aug. 30, 1983

[54] AM QUADRATURE STEREO SYSTEMS

[76] Inventors: Charles B. Fisher, 2850 Hill Park Rd., Montreal, Quebec H3H 1T1; Sidney T. Fisher, 53 Morrison Ave., Montreal, Quebec H3R 1K3, both of Canada

[21] Appl. No.: 410,313

[22] Filed: Aug. 23, 1982

[51] Int. Cl.[3] ..... H04H 5/00

[52] U.S. Cl. ..... 179/1 GS

[58] Field of Search ..... 179/1 GB, 1 GC, 1 GD, 179/1 GE, 1 GS, 1 GQ; 329/50, 167; 332/17, 21, 22, 40, 41; 455/91, 102, 103, 108, 109, 202–204, 295, 296, 337

[56] References Cited

U.S. PATENT DOCUMENTS 3,122,610 2/1964 Csicsatka ..... 179/1 GD 4,182,932 1/1980 Fisher et al. ..... 179/1 GS 4,225,751 9/1980 Hershberger ..... 179/1 GS 4,236,042 11/1980 Leitch ..... 179/1 GS

*Primary Examiner*—A. D. Pellinen

[57] ABSTRACT

Compatible AM quadrature stereo systems generating a carrier amplitude modulated by the signal sum, predistorted to cancel distortion in an envelope detector in a receiver caused by quadrature sidebands, and angle modulated by a pilot and the signal difference. The receiver separates the amplitude and angle modulation of the carrier, and delivers the signals separately. The transmitting apparatus may have multiple modulation circuits with linear amplifiers, may be an unequalized AM mono transmitter with auxiliary angle modulation apparatus, or may be an equalized AM mono transmitter. The signal sum received by a mono receiver with an envelope detector is substantially free from distortion. Noise-reduction circuits may be used in the stereo receiver, which delivers the signals separately without distortion.

9 Claims, 7 Drawing Figures

AM QUADRATURE STEREO SYSTEMS

BACKGROUND OF THE INVENTION

Compatible AM quadrature stereo systems in which the distortion caused by quadrature sidebands in a mono envelope detector is cancelled by predistortion of the signal sum by negative feedback at the transmitter.

In the prior art modified quadrature systems reduce the signal-difference amplitude by more than 11 dB, to secure reasonable freedom from harmonic distortion in a mono receiver with an envelope detector, and use synchronous sampling at the receivers. Other prior art stereo systems reduce the distortion by a material increase in complexity of the transmitting and receiving apparatus.

This invention discloses quadrature stereo systems which transmit a quadrature stereo wave, altered by negative feedback so that distortion in a mono receiver with an envelope detector, due to the quadrature sidebands, is significantly reduced. The stereo receivers use envelope and angle modulation detectors for separation of the signals, and sampling and reconstruction means for reduction of the noise.

SUMMARY OF THE INVENTION

The invention includes transmission apparatus for a first signal and a second signal; a first combination of the signals generating in-phase sidebands on a carrier, and a second combination of the signals plus a pilot generating quadrature sidebands on the carrier. A portion of the carrier with the sidebands is delivered through an envelope detector, filter and equalizer in a negative-feedback loop, to be subtracted from the first combination so that the in-phase sidebands are non-linearly predistorted, due to the presence of quadrature sidebands at the input to the envelope detector. When the transmission is subsequently received by a mono or stereo receiver with an envelope detector for the in-phase sidebands, the presence of quadrature sidebands at the envelope detector of the receiver causes non-linear distortion, which substantially cancels the non-linear predistortion of the in-phase sidebands, and the first signal combination is recovered free from distortion.

Thus this stereo system has the advantages of a quadrature or modified quadrature system of the prior art, as regards an RF bandwidth not wider than a mono bandwidth, and simplicity of transmitter and receiver circuits, with the added feature of low distortion of the first signal combination in a mono receiver with an envelope detector. An additional advantage is that the in-phase and quadrature sidebands may have the same range of amplitude, so that the signal-to-noise ratio of the two signal combinations may have the same range.

The transmitting apparatus may consist of an efficient combination of a non-linear carrier amplifier, with a linear amplifier for the in-phase and quadrature sidebands; an AM mono transmitter with additional angle modulating apparatus; or an AM mono transmitter with phase linearity equalization of the RF and AF paths across wide bands, and gain equalization of the AF path across a wide band.

In a mono or stereo receiver the first signal combination is recovered in an envelope detector, free from distortion due to the presence of quadrature sidebands. In a first version of a stereo receiver the first signal combination is delivered from an envelope detector free from the second combination and distortion, and the second combination is delivered from an angle modulation detector following an amplitude limiter, free from the first signal combination.

In a second version of a stereo receiver the stereo transmission with superimposed noise is sampled at instants of unmodulated carrier peaks of a single polarity, alternately reversed, and reconstructed in analog form as the carrier amplitude modulated by the first signal combination; from which the first signal combination, less superimposed noise, the second signal combination and distortion, is delivered by an envelope detector. The stereo transmission is also sampled at instants of unmodulated carrier zero-crossings, separated an integral number of carrier periods, alternately reversed and reconstructed in analog form as the second signal combination and pilot, free from superimposed noise and the first signal combination. Signal matrixes are used at both the transmitter and the stereo receiver to relate the first and the second signal combinations to the first signal and the second signal.

DETAILED DESCRIPTION OF THE ILLUSTRATED EMBODIMENTS

In this invention the first signal combination is predistorted by negative feedback and delivered to the transmitting apparatus to produce in-phase sidebands of the carrier, so that in the stereo wave delivered to the envelope detector of a stereo or mono receiver the predistortion of the first signal combination is cancelled by distortion due to quadrature sidebands of the second signal combination present at the envelope detector. The first signal combination may be the sum of the first and second signals and the second signal combination the difference of the first and second signals, or the first signal combination may be the difference of the first and second signals and the second signal combination the sum of the first and second signals. The second signal combination and the pilot produce quadrature sidebands of the carrier in the bandwidth of the in-phase sidebands.

This invention discloses a generalized and three specific transmitting means, and a generalized and two specific receiving means, for predistorted AM quadrature stereo transmissions.

Figure 1:
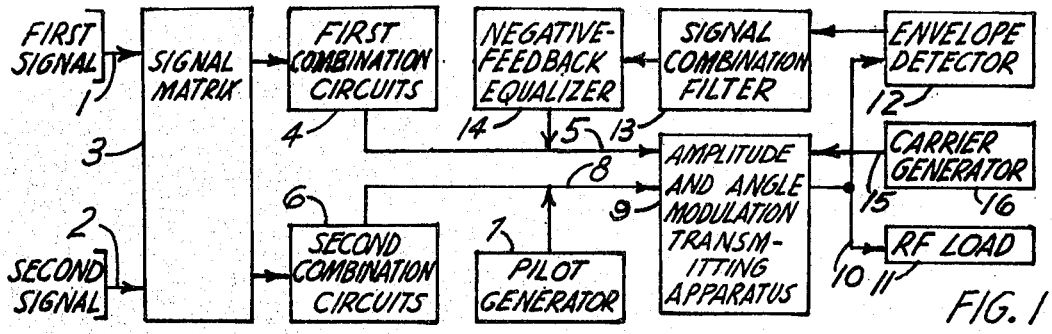
FIG. 1 shows a generalized and simplified block schematic circuit diagram of stereo transmitting means according to the invention.

FIG. 1 shows a simplified block schematic circuit diagram of generalized transmitting means according to the invention.

The first signal, on lead 1, is delivered to the first input of signal transmitting matrix 3, and the second signal, on lead 2, is delivered to the second input of matrix 3. The first output of matrix 3 delivers the first signal combination to first combination circuits 4. Circuits 4 have predetermined delay (including zero) and loss, and deliver the output over lead 5 to the amplitude modulation input of amplitude and angle modulation transmitting apparatus 9.

The second output of matrix 3 delivers the second combination of the signals to second combination circuits 6. Circuits 6 have predetermined delay (including zero) and loss, and deliver the output, together with the output from pilot generator 7, having a frequency below the lowest signal frequency, over lead 8 to the angle modulation input of apparatus 9. Unmodulated carrier is delivered by carrier generator 16 to apparatus 9 over lead 15. The output of apparatus 9, consisting of a carrier with in-phase predistorted sidebands, and quadrature pilot and signal sidebands, is delivered over lead 10 to RF load 11 and envelope detector 12. Detector 12 is subjected to combined in-phase and quadrature sidebands, as is the envelope detector in a mono receiver receiving a wave from RF load 11. The two envelope detectors therefore generate the same distortion of the first signal combination due to the presence of quadrature sidebands. In FIG. 1 the output of detector 12 is returned in a negative-feedback loop through first signal combination filter 13, which passes the first signal combination and pilot, and negative-feedback equalizer 14 to equalize the delay and frequency response around the negative-feedback loop, to permit substantial amounts of negative feedback, in accordance with circuit theory, without oscillation or other harmful effects, to the output of first signal combination circuits 4. This negative-feedback loop, to a first approximation, subtracts the distortion of envelope detector 12 from the first signal combination input to apparatus 9 on lead 5, and hence predistorts the in-phase sidebands.

Figure 2:
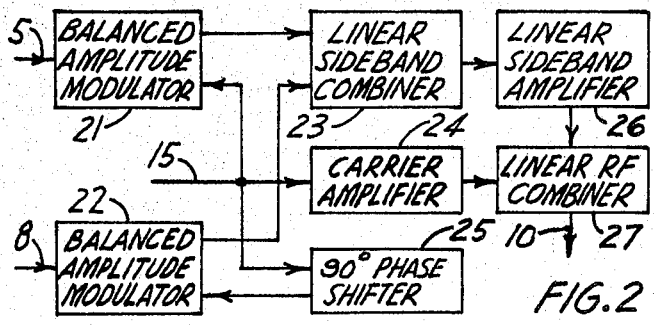
FIG. 2 shows a simplified block schematic circuit diagram of a first version of the transmitting apparatus of FIG. 1, with separate carrier and sideband amplifiers.

FIG. 2 shows a simplified block schematic circuit diagram of amplitude and angle modulation transmitting apparatus 9 of FIG. 1, using a linear sideband amplifier. This forms an efficient and economical stereo transmitting means, when incorporation of existing AM mono equipment is not desired.

In FIG. 2, lead 5 of FIG. 1 delivers the adjusted predistorted first signal combination to balanced amplitude modulator 21, which delivers predistorted in-phase sidebands to linear sideband combiner 23. A carrier of substantially constant amplitude and substantially constant frequency is delivered over lead 15 of FIG. 1 as a carrier for modulator 21, and through 90° carrier phase shifter 25 as a carrier for balanced amplitude modulator 22. The carrier is amplified by carrier amplifier 24 and delivered to linear RF combiner 27. The adjusted second signal combination and pilot are delivered over lead 8 of FIG. 1 to modulator 22, which generates quadrature sidebands. These are delivered to sideband combiner 23, the output of which is amplified in linear sideband amplifier 26 and delivered to RF combiner 27, so that the sidebands from modulator 21 are in-phase sidebands, and the sidebands from modulator 22 are quadrature sidebands, with reference to the carrier, on lead 10 of FIG. 1, at the output of RF combiner 27. Combiner 23 and amplifier 26 may form a single unit.

Figure 3:
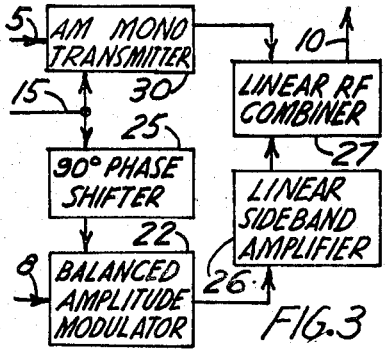
FIG. 3 shows a simplified block schematic circuit diagram of a second version of the transmitting apparatus of FIG. 1, with an unequalized AM mono transmitter and separate angle modulation means.

FIG. 3 shows a simplified block schematic circuit diagram of amplitude and angle modulation transmitting apparatus 9 of FIG. 1, using a conventional unequalized AM mono transmitter with auxiliary angle-modulation apparatus. This is an efficient and economical stereo transmitter when incorporation of existing AM mono equipment in a stereo transmitter is desired.

In FIG. 3 lead 5 of FIG. 1 delivers the adjusted predistorted first signal combination to unequalized AM mono transmitter 30. This is a conventional AM mono transmitter, which delivers a carrier with in-phase sidebands to linear RF combiner 27 and then to lead 10 of FIG. 1. Transmitter 30 may have an RF channel, from the unmodulated carrier supply on lead 15 of FIG. 1 to lead 10 of FIG. 1, which may not transmit an angle-modulated wave having a bandwidth greater than three times the highest signal-difference frequency without substantial nonlinearity of phase, and an AF channel which may not pass a tone varying from 30 Hz to twice the highest signal-sum frequency without substantial non-linearity of phase and gain.

Unmodulated carrier is supplied over lead 15 to 90° carrier phase shifter 25, and then as carrier to balanced amplitude modulator 22, and transmitter 30.

The input of balanced amplitude modulator 22 on lead 8 of FIG. 1 generates quadrature sidebands which are delivered to linear sideband amplifier 26 and from there as quadrature sidebands to RF combiner 27.

Figure 4:
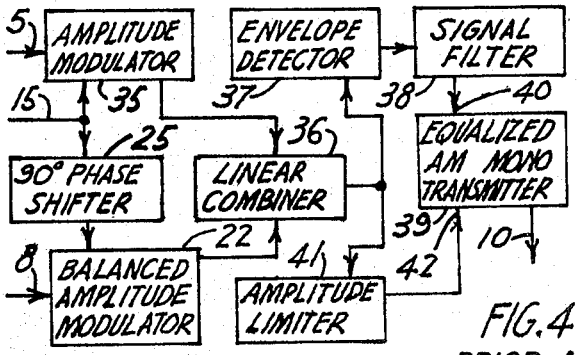
FIG. 4 PRIOR ART
FIG. 4 shows a prior art simplified block schematic circuit diagram of a third version of the transmitting apparatus of FIG. 1, with an equalized AM mono transmitter driven by a stereo exciter through an interface.

FIG. 4 shows a simplified block schematic circuit diagram of amplitude and angle modulation transmitting apparatus 9 of FIG. 1, using an AM mono transmitter 39, with lead 5 carrying as input the first signal combination, strongly distorted by negative feedback, delivered by envelope detector 12, signal combination filter 13 and negative-feedback equalizer 14, which receive carrier, in-phase sidebands and quadrature sidebands from lead 10. This feedback circuit, as shown in FIG. 1, causes lead 5 of FIG. 4 to carry a different wave and to perform a different function than in AM transmitters of the prior art. In FIG. 4 AM transmitter 39 has closely equalized RF and AF channels, and a stereo exciter and interface. This may be an economical arrangement when incorporation of existing AM mono apparatus is desirable.

Lead 5 of FIG. 1 delivers adjusted predistorted first signal combination to amplitude modulator 35, which receives unmodulated carrier over lead 15 of FIG. 1 and delivers predistorted in-phase sidebands and carrier to linear combiner 36. Lead 8 of FIG. 1 delivers the adjusted second signal combination and the pilot to balanced amplitude modulator 22, supplied with carrier from lead 15 through 90° phase shifter 25, which delivers second signal combination and pilot quadrature sidebands to linear combiner 36.

Part of the output of combiner 36 is delivered through envelope detector 37 and first signal combination and pilot filter 38 to the AF input 40 of transmitter 39. Part of the output of combiner 36 is delivered through amplitude limiter 41 to the RF input 42 of transmitter 39, as carrier angle modulated by the second signal combination and the pilot. The stereo modulated wave is delivered on lead 10 of FIG. 1. FIG. 4 is the well known circuit of a stereo exciter with an interface to an equalized AM mono transmitter, and is included here to show clearly its connections in FIG. 1.

Since the adjusted first signal combination on lead 5 is distorted, and the signal difference on lead 8 is not distorted, accurate generation of in-phase and quadrature sidebands does not take place, and in order to minimize mono receiver distortion some reduction of level on lead 8 may be necessary.

Apparatus 39 consists of an AM mono transmitter with the RF channel closely equalized in linearity of phase over a bandwidth greater than three times the highest signal frequency, and an AF channel which passes a tone varying from 30 Hz to twice the highest signal frequency, without substantial non-linearity of phase or gain.

In FIG. 1, first signal combination delay and gain circuits 4 and second signal combination delay and gain circuits 6 are set to values so that the delay from matrix 3 to RF load 11 is the same for the in-phase sidebands relative to the first signal combination, as for the quadrature sidebands relative to the second signal combination.

Figure 5:
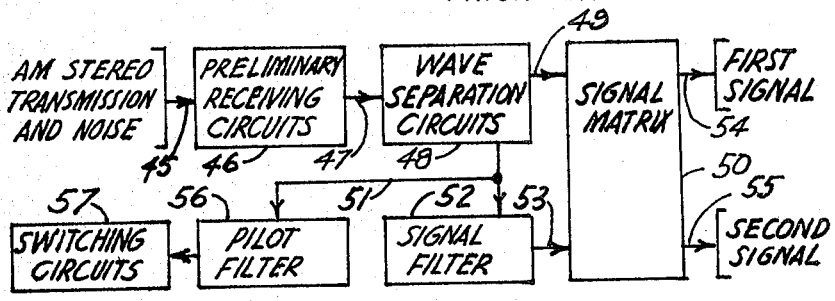
FIG. 5 shows a generalized and simplified block schematic circuit diagram of AM stereo receiving means for the transmission from FIG. 1.

FIG. 5 shows a simplified block schematic circuit diagram of generalized receiving means according to the invention.

In FIG. 5 an AM quadrature stereo transmission, as generated by the transmitting means of FIG. 1, with superimposed noise, is delivered as the input to lead 45 and is received, selected and amplified in preliminary receiving circuits 46, which deliver the output over lead 47 to wave separation circuits 48. Separation circuits 48 deliver the first signal combination over lead 49 to the first input of signal receiving matrix 50.

Separation circuits 48 deliver the second signal combination and the pilot over lead 51 to pilot filter 56, which passes the pilot to stereo switching circuits 57. On actuation by the pilot, switching circuits 57 connect the receiver circuits for stereo reception and actuate a stereo indicator. When pilot is not present, switching circuits 57 connect the receiver circuits for mono reception.

Separation means 48 delivers the second signal combination and pilot to filter 52, which passes the second signal combination, but not the pilot, on lead 53 to the second input of matrix 50. The first output of matrix 50 on lead 54 delivers the first signal and the second output on lead 55 delivers the second signal.

The timing from lead 45 to matrix 50 of the in-phase sidebands relative to the signals is made substantially equal, by suitable design of circuits 48, or otherwise, to the timing from lead 45 to matrix 50 of the quadrature sidebands relative to the signals.

Figure 6:
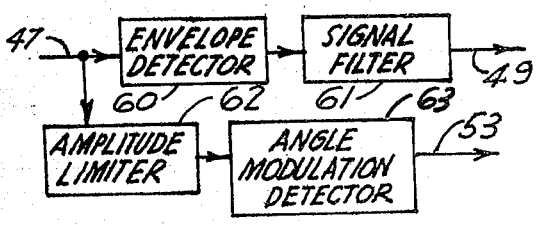
FIG. 6 shows a simplified block schematic circuit diagram of a first version of the wave separation circuits of FIG. 5, using an envelope detector and an amplitude limiter to separate the signals.

FIG. 6 shows a simplified block schematic circuit diagram of a first version of wave separation circuits 48 of FIG. 5, using an envelope detector and an amplitude limiter as wave separation means.

In FIG. 6 lead 47 of FIG. 5 delivers its output to envelope detector 60 and amplitude limiter 62. The output of detector 60 is delivered to filter 61 which passes the signals, but not the carrier or pilot, over lead 49 of FIG. 5.

The output of amplitude limiter 62, where the amplitude modulation is substantially removed, is delivered to angle modulation detector 63, which delivers the second signal combination and the pilot over lead 53 of FIG. 5. In this case pilot and switching circuits if required may be connected between the output of detector 63 and lead 53, as shown by lead 51, signal filter 52, pilot filter 56 and switching circuits 57.

Figure 7:
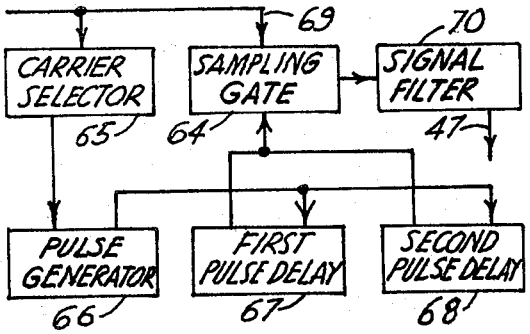
FIG. 7 shows a simplified block schematic circuit diagram of noise reducing circuits which may be introduced into the preliminary receiving circuits of FIG. 5, using a bipolar sampling gate to reduce superimposed noise.

FIG. 7 shows a simplified block schematic circuit diagram of noise-reducing circuits which may be introduced into preliminary receiving circuits 46 of FIG. 5, in which superimposed noise is removed from the input on lead 47, by sampling and reconstruction means, before separation of the signals. As in FIG. 6 the receiver selective circuits are preferably wide enough and symmetrical enough to avoid converting angle modulation to amplitude modulation, and vice versa.

Lead 69 delivers modulated carrier with superimposed noise to bipolar sampling gate 64 and to carrier selector 65, which by one or more of selectivity, amplitude limiting and oscillator synchronization delivers the carrier substantially free from sidebands and noise to pulse generator 66, which generates a stream of short pulses of alternate polarity, at the frequency of the carrier on lead 69 divided by an integer, and delivers the pulses to first pulse delay circuit 67 and to second pulse delay circuit 68.

First pulse delay circuit 67 delays the pulses at instants of unmodulated carrier peaks on lead 69, and delivers them as gating pulses to gate 64. This is a bipolar gate, that is for one polarity of gating pulse it delivers a sample of the same polarity as the input wave, and for the other polarity of gating pulse it delivers a sample of the polarity opposed to the input wave. Thus due to the pulses from delay circuit 67, gate 64 delivers a stream of alternately reversed samples of the modulated carrier, of alternate polarity, and a stream of alternately reversed samples of noise of random phase and amplitude, taken at instants of peaks of the unmodulated carrier on lead 69. These samples are delivered to reconstruction filter 70, which which has the bandwidth of the modulated carrier on lead 47. In accordance with the sampling principle the stream of alternately reversed amplitude modulated carrier samples is reconstructed in analog form as a modulated carrier, and the stream of alternately reversed noise samples is reconstructed in analog form as two noise waves, equal in amplitude and opposed in polarity at every instant, which cancel one another.

Second pulse delay circuit 68 delays the pulses from generator 66 to instants of unmodulated carrier zero-crossings on lead 69, as gating pulses, and hence gate 64 delivers a stream of alternately reversed samples of the quadrature sidebands of alternate polarity, and a stream of alternately reversed samples of noise of random phase and amplitude, taken at instants of zero-crossings of the unmodulated carrier on lead 69. These samples are delivered to reconstruction filter 68, where the stream of sideband samples is reconstructed in analog form as quadrature sidebands, and the stream of noise samples is reconstructed as before to cancel the noise.

The output of filter 70 on lead 47 has the same composition as the wave on lead 69, less the superimposed noise. Lead 47 delivers its output to signal separation circuits which are an exact replica of circuit 48 of FIG. 6, and hence are not again described.

Since many changes could be made in the above method and many apparently widely different embodiments of this invention could be made without departing from the scope thereof, it is intended that all matter contained in the above description or shown in the accompanying drawings shall be interpreted as being illustrative only and not limiting.

We claim:

1. The method of stereo transmission which comprises:

receiving a first signal, and receiving a second signal, and generating a carrier of substantially constant amplitude and constant frequency, and generating a pilot of substantially constant amplitude and constant frequency, and forming in-phase sidebands on said carrier by a first combination of said first and said second signals, predistorted to substantially cancel subsequent distortion of said first combination in an envelope detector, due to the presence of quadrature sidebands, and forming said quadrature sidebands on said carrier by a second combination of said first and said second signals, and by said pilot, and delivering said carrier, said in-phase and said quadrature sidebands to a load circuit.

2. The method of transmission of claim 1 in which said first combination is the sum of said first and second signals, and said second combination is the difference of said first and said second signals.

3. The method of transmission of claim 1 in which said first combination is the difference of said first and second signals, and said second combination is the sum of said first and second signals.

4. The method of transmission according to claim 1, which comprises:

forming said first combination of said signals, and forming said second combination of said signals, and adjusting the delay and amplitude of said first combination of signals by predetermined amounts, and forming in-phase sidebands on said carrier with said adjusted first combination, and adjusting the delay and amplitude of said second combination of signals by predetermined amounts, and forming quadrature sidebands on said carrier with said adjusted second combination and said pilot, and delivering a portion of said carrier with said in-phase and said quadrature sidebands to an envelope amplitude modulation detector, and delivering the output of said envelope detector to a filter passing said first combination and said pilot, but not passing said carrier, and delivering the output of said first combination filter to an equalizer which equalizes the negative-feedback loop, of which said first combination filter forms part, in delay and frequency response, and delivering the output of said equalizer to distort said adjusted first signal combination before forming said in-phase sidebands, so that every component in said adjusted first signal combination is opposed in phase to, and is reduced by, the amplitude of the component of the same frequency in the output of said equalizer by a substantial amount, and distorts said first signal combination and said in-phase sidebands.

5. The method in accordance with claim 4 of delivering said carrier and said sidebands to said load circuit, which comprises:

amplitude modulating and suppressing said carrier by said adjusted first signal combination and the output of said equalizer, to produce predistorted in-phase sidebands, and amplitude modulating and suppressing said carrier, shifted in phase by 90°, by said adjusted signal difference and said pilot, to produce quadrature sidebands, and linearly combining said predistorted in-phase sidebands and said quadrature sidebands, and linearly amplifying said combined in-phase and quadrature sidebands, and amplifying said carrier, and linearly combining said amplified sidebands and said amplified carrier, so that said amplified in-phase sidebands are in phase and said amplified quadrature sidebands are in quadrature with said amplified carrier, and delivering said combined amplified sidebands and said amplified carrier to said load circuit.

6. The method in accordance with claim 4, of delivering said carrier and said sidebands to said load circuit, which comprises:

delivering said adjusted first signal combination and the output of said equalizer to the amplitude modulation input of an amplitude modulation mono transmitter, to produce in-phase sidebands, and delivering said carrier to said mono transmitter as carrier input, to produce an amplified carrier output, and shifting said carrier in phase by 90°, and amplitude modulating and suppressing said carrier shifted in phase, by said adjusted second signal combination and said pilot, to produce quadrature sidebands, and linearly amplifying said quadrature sidebands, and linearly combining said in-phase sidebands and the amplified carrier at the output of said mono transmitter, and said amplified quadrature sidebands, so that sidebands produced by said mono transmitter are in in-phase relationship and said amplified quadrature sidebands are in quadrature relationship with the amplified carrier delivered by said mono transmitter, and delivering said combined amplified quadrature sidebands and said mono transmitter output to said load circuit.

7. The method in accordance with claim 4, of delivering said carrier and said sidebands to said load circuit, which comprises:

amplitude modulating said carrier by said adjusted first signal combination and the output of said equalizer, to produce in-phase sidebands and amplified carrier, and shifting said carrier in phase by 90°, and amplitude modulating and suppressing said carrier shifted in phase, by said adjusted second signal combination and said pilot, to produce quadrature sidebands, and linearly combining said carrier, said in-phase sidebands and said quadrature sidebands produced by said adjusted second signal combination and said pilot, and delivering said carrier, said in-phase sidebands and said quadrature sidebands to an envelope detector and to an amplitude limiter, and delivering the output of said envelope detector to a filter which passes said pilot and said first signal combination but does not pass said carrier, and delivering the output of said filter to the amplitude modulation input of an equalized amplitude modulation mono transmitter, which has the modulation path equalized in linearity of phase and frequency response over a wide frequency band, and the carrier path equalized in linearity of phase over a wide frequency band, and delivering the output of said amplitude limiter to the carrier input of said equalized mono transmitter, and delivering the output of said equalized mono transmitter to said load circuit.

8. The method of receiving AM stereo transmission; consisting of or equivalent to a carrier of substantially constant amplitude and frequency; with in-phase sidebands produced by amplitude modulation of said carrier by a first combination of a first signal and a second signal, said first combination of said signals being predistorted by negative feedback produced by passing said carrier with said in-phase sidebands and quadrature sidebands through an envelope detector; and said quadrature sidebands, produced by amplitude modulation of said carrier, shifted substantially 90 deg. in phase, by a second combination of said first signal and said second signal, and by a pilot of substantially constant frequency and amplitude and lying in frequency below said signals; with superimposed noise; which comprises:

receiving and amplifying said stereo transmission and said noise, in receiving circuits, and delivering said stereo transmission and said noise to an envelope detector, to produce said first signal with said predistortion substantially cancelled, and substantially free from said second signal combination and said pilot, and delivering said stereo transmission and said noise to an amplitude limiter followed by an angle modulation detector, to produce said second signal combination and said pilot, substantially free from said first signal combination, and Separating said pilot from said second signal combination by filtering means, and using said pilot for at least one of indication and switching functions, and delivering said first signal and said second signal combination to a signal matrix, which delivers said first signal at a first output and delivers said second signal at a second output.

9. The method of receiving an AM stereo transmission with superimposed noise, according to claim 8, with substantial reduction of said noise, which comprises:

delivering said transmission and said noise to said receiving circuits, including noise reduction circuits, and delivering said transmission and said noise from said receiving circuits, before passing through said noise reducing circuits of said receiving circuits, to a carrier selector, and selecting said carrier of said transmission, substantially free from said sidebands and said noise, and delivering said carrier from said carrier selector to a pulse generator, generating short pulses of alternate polarities at intervals equal to the period of said carrier multiplied by an integer, and receiving and delaying said pulses of a first polarity in a second pulse-delay circuit, to approximate instants of peaks of said carrier, and receiving and delaying said pulses of a second polarity in a second pulse-delay circuit to approximate instants of zero-crossings of said carrier, and delivering said transmission and said noise in said receiving circuits to a bipolar receiving gate, and delivering said pulses from said pulse-delay circuits to said bipolar gate as gating pulses, and delivering the output of said sampling gate to a filter with a pass-band substantially the same as the modulated carrier produced by integration of the output of said sampling gate, and delivering the output of said filter to said envelope detector and said amplitude limiter.

* * * * *